US010801288B2

(12) United States Patent
Molaschi et al.

(10) Patent No.: US 10,801,288 B2
(45) Date of Patent: Oct. 13, 2020

(54) VALVE ASSEMBLY AND CONTROL METHOD FOR EXTRACTION WELLS UNDER EMERGENCY CONDITIONS

(71) Applicant: ENI S.p.A., Rome (IT)

(72) Inventors: Claudio Molaschi, Crema (IT); Alberto Maliardi, San Donato Milanese (IT); Alessio Nista, Spinea (IT)

(73) Assignee: ENI S.p.A., Rome (IT)

( * ) Notice: Subject to any disclaimer, the term of this patent is extended or adjusted under 35 U.S.C. 154(b) by 273 days.

(21) Appl. No.: 15/520,493

(22) PCT Filed: Oct. 22, 2015

(86) PCT No.: PCT/IB2015/058156
§ 371 (c)(1),
(2) Date: Apr. 20, 2017

(87) PCT Pub. No.: WO2016/063245
PCT Pub. Date: Apr. 28, 2016

(65) Prior Publication Data

US 2017/0314354 A1 Nov. 2, 2017

(30) Foreign Application Priority Data

Oct. 23, 2014 (IT) ..... MI2014A1830

(51) Int. Cl.
*E21B 29/08* (2006.01)
*E21B 33/06* (2006.01)
(Continued)

(52) U.S. Cl.
CPC ..... *E21B 29/08* (2013.01); *E21B 33/06* (2013.01); *E21B 29/00* (2013.01); *E21B 33/00* (2013.01)

(58) Field of Classification Search
CPC ..... E21B 29/08; E21B 29/00; E21B 33/06; E21B 33/00
(Continued)

(56) References Cited

U.S. PATENT DOCUMENTS 5,931,442 A 8/1999 Cummins
2006/0021749 A1* 2/2006 Schaeper ..... E21B 33/063 166/55
(Continued)

FOREIGN PATENT DOCUMENTS

CN 201170080 Y 12/2008
CN 102536150 A 7/2012
(Continued)

OTHER PUBLICATIONS

Combined Office Action and Search Report dated Sep. 12, 2018 in Chinese Patent Application No. 201580063460.1 (with English translation), 12 pages.
(Continued)

*Primary Examiner* — Matthew R Buck
*Assistant Examiner* — Patrick F Lambe
(74) *Attorney, Agent, or Firm* — Oblon, McClelland, Maier & Neustadt, L.L.P.

(57) ABSTRACT

A safety valve assembly for extradition of hydrocarbons includes a valve body including a passage duct, configured to be traversed by a production and/or drilling line. The valve body includes housings for a punch and counter-punch, arranged diametrically opposite to one another with a common longitudinal axis substantially perpendicular to the longitudinal axis of the valve. The punch slides linearly in a controlled manner in the housing along the axis which intersects the longitudinal axis of the pipe, and the counter-punch slides linearly in a controlled manner in the housing along the axis which intersects the longitudinal axis of the
(Continued)

pipe. The punch and counter-punch are configured to allow the counter-punch to slidingly receive the punch in its interior to create two different shearing planes. The counter-punch includes a hollow part to slidingly receive the section of tubular material and the punch, in the linear movement during the shearing operation.

17 Claims, 11 Drawing Sheets

(51) Int. Cl.
*E21B 29/00* (2006.01)
*E21B 33/00* (2006.01)

(58) Field of Classification Search
USPC ..... 166/363
See application file for complete search history.

(56) References Cited

U.S. PATENT DOCUMENTS

| | | | | |
|---|---|---|---|---|
| 2010/0319906 | A1 | 12/2010 | Van Winkle | |
| 2013/0299172 | A1 | 11/2013 | Van Winkle | |
| 2014/0001390 | A1 | 1/2014 | Alexander et al. | |
| 2014/0014356 | A1* | 1/2014 | Herland | E21B 34/04 166/368 |

FOREIGN PATENT DOCUMENTS

| | | | |
|---|---|---|---|
| CN | 202467761 | U | 10/2012 |
| CN | 103189593 | A | 7/2013 |
| CN | 103249907 | A | 8/2013 |
| WO | WO 99/25611 | A1 | 5/1999 |

OTHER PUBLICATIONS

International Search Report and Written Opinion dated Feb. 2, 2016 in PCT/IB2015/058156.

* cited by examiner

VALVE ASSEMBLY AND CONTROL METHOD FOR EXTRACTION WELLS UNDER EMERGENCY CONDITIONS

The present invention relates to a valve assembly and relative method for controlling extraction wells under emergency conditions, in particular, it relates to a valve assembly for the management of extraction wells, such as, for example wells for the extraction of hydrocarbons (petroleum and/or gas), under emergency conditions arising from uncontrolled eruption of the well (blow-out) or from transitory overpressures coming from the reservoir formation (kick).

The growing tendency of the Oil & Gas industry to explore in offshore areas at increasing depths, as a result leads to the necessity of guaranteeing a continuous improvement in the safety level for wellheads on sea or ocean bottoms at depths close to 4000 meters; the capacity and effectiveness of intervening in the case of emergencies at these depths represents a necessity and challenge for the future which is orienting technique towards security solutions that integrate the current capacities of blow-out preventers (BOPS) installed on the production crosses and existing safety valves inside the wellhead.

At present, blow-out preventers are devices installed redundantly for guaranteeing an effective intervention in the case of emergencies.

The main functions of BOPs are to control the volumes of well fluid, center the drill pipes, close and seal the well. Two categories of BOPs can be mainly distinguished: annular and ram. Whereas annular devices adopt a control element of the volume of fluids and closing of the well having an annular form, ram devices implement a gate or guillotine mechanism made of metallic or elastomeric material capable of exerting a closing and hydraulic sealing action with or without the presence of tubular material inside the valve. Particular BOPs called "shear rams" can induce shear stress on the tubular materials engaged in the valve body of the BOP so as to shear them and obtain the desired results.

A well-eruption prevention system is normally composed of a series of redundant BOPs which exploit various functioning systems (annular and ram) to ensure a greater effectiveness. The intervention times of BOPs generally range from tens of seconds to minutes thanks to dedicated actuations and hydraulic controls.

Although the barrier formed by BOPs represents a significant safety means with respect to emergency events, some limits on their functioning can be detected.

The capacity of shearing drill pipes engaged in BOPs is limited and does not comprise the shearing of joining components between the rods (tool joints) having a larger thickness and diameter with respect to the rods themselves. The BOPs must be maintained and the seals substituted at the end of the drilling operations. In the case of shearing with systems that induce shear stress (shear rams), the cutting action on the drill pipe is exerted so as to guarantee the separation of the two sections of rod and the subsequent closing of the well if the rod is in a centered position with respect to the passage pipe of the valve. In cases where the drill string is compressed by the pressure of the well or is diverted laterally, its shearing risks to be incomplete or with a deformed residual material which does not allow the subsequent closing phase of the well through the sealing element. The passage of the cutting elements provides that the rod is sheared after a complete crushing of the section which only occurs in the central part of the rod.

The area of the tool joint, subjected to the action of the cutting elements, tends to break with reduced crushing and with unforeseeable fracture lines; consequently some metal debris may remain entrapped, blocking the stroke of the shearing elements and thus preventing the closing of the well.

The objective of the present invention is to provide a valve that overcomes the drawbacks of the known art, allowing the well to be closed even after a possible ineffective intervention of the BOPs.

According to the present invention, a safety valve for extraction wells of hydrocarbons is provided, which allows the tubular drilling material possibly present in the safety valve to be cut and the closing of the well with a hydraulic-seal.

According to the present invention, a safety valve for extraction wells of hydrocarbons is provided, that is capable of exerting the shearing action of the tubular material with a higher capacity than conventional BOPs, considering the worst stress conditions created in correspondence with the wellhead, currently not contemplated by said BOPs. In particular, the safety valve according to the invention is capable of severing a wide range of tubular elements in its interior, among which: casings having an outer diameter preferably ranging from 1" to 20", with a wall thickness preferably up to about 20 mm, drill pipes having an external diameter preferably ranging from 1" to 10", with a wall thickness preferably up to about 20 mm and tool joints having an external diameter preferably ranging from 1" to 10", with a wall thickness preferably up to about 40 mm.

A first object of the present invention therefore relates to a safety valve assembly AV comprising a valve body 2 in which there is a passage duct 24, preferably straight, configured to be passed through by a production and/or drilling line designed for containing and transporting, through a tubular element 26, extraction fluids or other fluids to be extracted from an underground reservoir, said valve assembly AV being provided with a punch 4 sliding linearly in a controlled mode along the axis A2 which intersects the longitudinal axis of the pipe A1 and a counter-punch 3, positioned diametrically opposite to the punch 4, sliding linearly in a controlled mode along said axis A2, said valve assembly AV being characterized in that the counter-punch 3 is configured so as to have a hollow part suitable for slidingly receiving the section of tubular material and the punch 4 in its interior, in the linear movement during the shearing operation, so as to create two different shearing planes.

A second object of the present invention relates to an extraction well comprising the valve assembly AV object of the present invention, as described hereunder.

A further object of the present invention relates to a method for managing an extraction well under emergency conditions, comprising the valve assembly AV, as described hereunder.

Further characteristics of the invention are indicated in the dependent claims, which are an integral part of the present description.

The characteristics and advantages of the present invention will appear evident from the following description of a non-limiting embodiment example, with reference to the figures of the enclosed drawings, in which.

Figure 2:
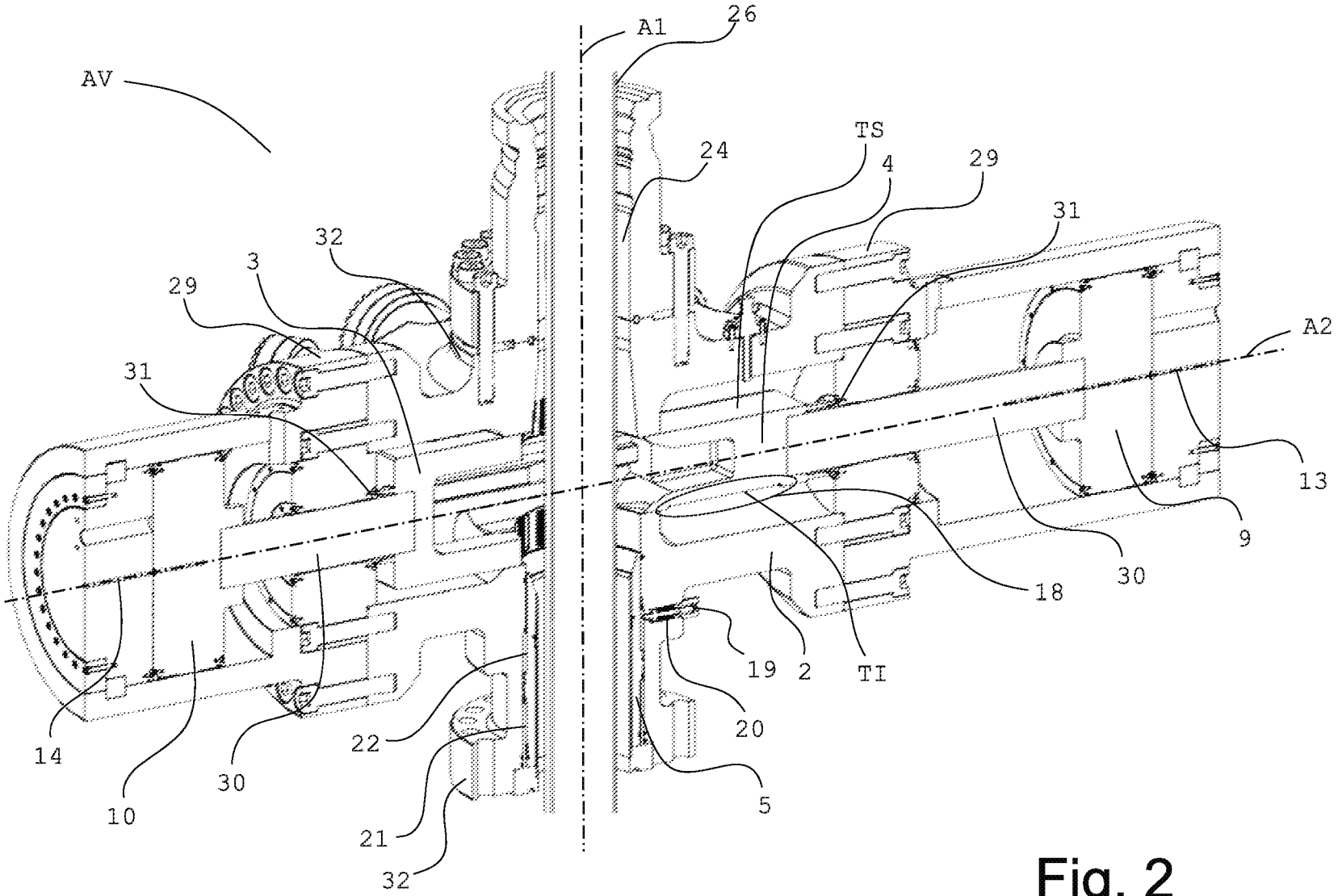
FIG. 2 is an axonometric view with parts of the safety valve in a sectional view, with components removed for the sake of clarity, which shows the valve body, the punch and the counter-punch with the relative actuation mechanisms.

FIGS. 8A-G show the various phases of the actuation procedure of the safety valve of FIG. 2 for obtaining the closing of the extraction well.

Figure 1:
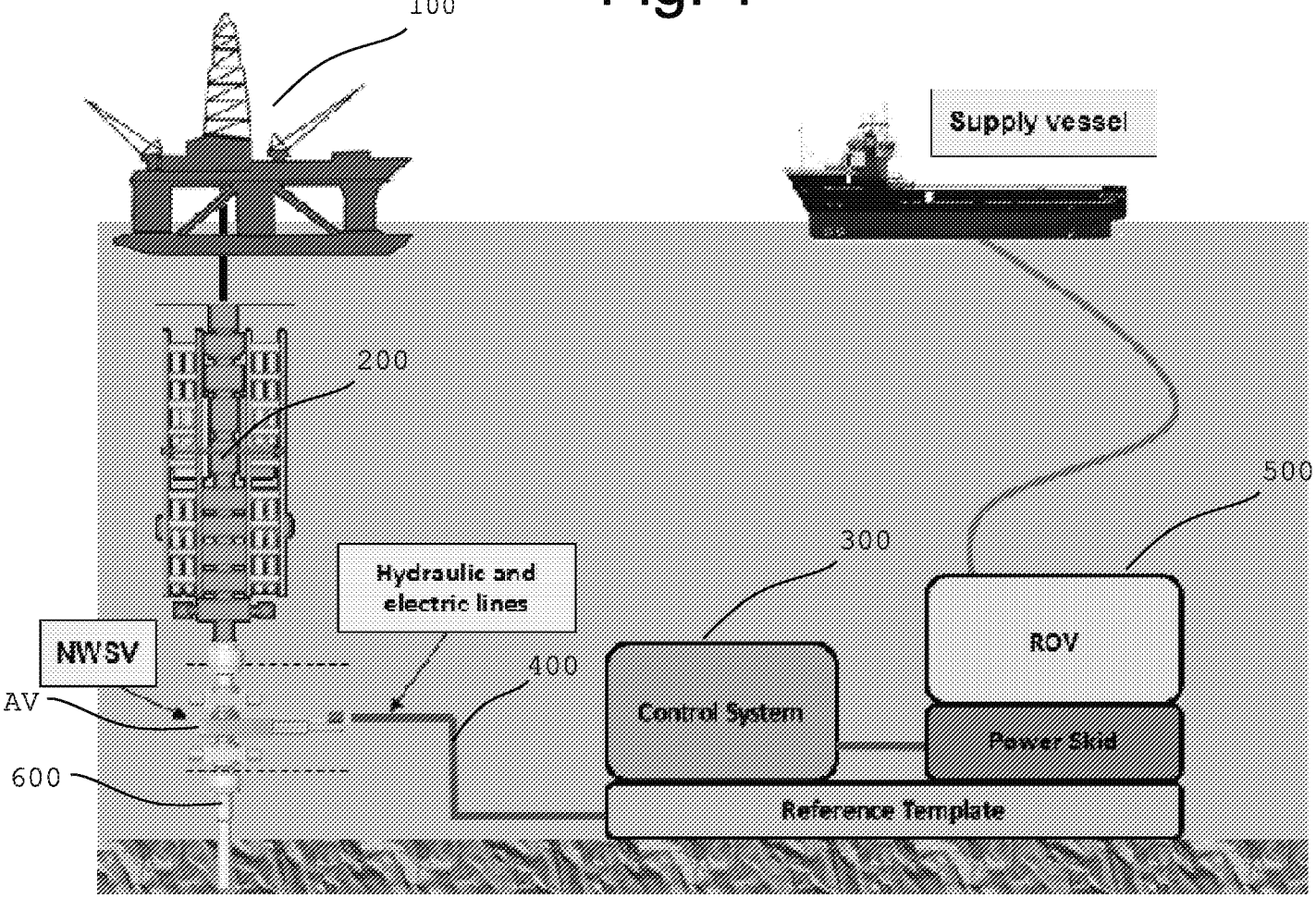
FIG. 1 is a schematic view of the drilling system comprising the safety valve according to the invention, positioned on an underwater wellhead, and the relative auxiliary systems useful for its functioning.

With reference in particular to FIG. 1, this shows a generic floating drilling rig 100 set up for the drilling of an underwater well. The safety-valve assembly according to the invention, indicated as a whole with the reference AV, is installed on the wellhead so as to allow, during the drilling phase, the installation of blow-out preventers (BOPs), indicated as a whole with the reference number 200. The wellhead can be of any type. More specifically, the wellhead can comprise a conductor pipe 600, cemented or in any case anchored or fixed to the sea bottom or other geological formation in which there is underground reservoir to be exploited, wherein the pipe 600 is in the proximity of the surface of the seabed or other geological formation in question; as shown in FIG. 1, an end of the anchoring pipe 600 can emerge or protrude from the sea bottom. The production cross can also be of the known type. At the end of the drilling, unlike the BOPs 200 that are removed, the safety-valve assembly AV can remain installed for the whole operational duration of the well. After installation, the safety-valve assembly can be left on the wellhead also during the production phase, when the BOP has been removed, remaining below the production cross.

In particular, the safety-valve assembly AV is configured to allow the passage of a tubular element 26, typically metallic, at least partially contained inside the well and oriented in the same axial direction as the well itself. The tubular element 26 is internally hollow and is designed for containing and transporting fluids and other substances extracted through the well, among which, for example, hydrocarbons (petroleum or natural gas), water, mud, rock debris and/or soil debris. The safety-valve assembly AV is operated by a remote power and control system 300 which can be installed either at a drill construction site (in the case of on-shore drillings), or on the sea bottom (in the case of off-shore drillings), at a predefined distance from the well. The technical characteristics of the safety-valve assembly AV, as will be better explained hereunder, are such as to not require maintenance during the operating life of the safety-valve assembly AV itself. The remote power and control system 300, however, can be removed to effect either programmed or occasional maintenance. In the case of off-shore drillings, the electric and hydraulic connections 400 between the remote power and control system 300 and the safety-valve assembly AV can be effected by means of an underwater ROV ("remotely operated vehicle") 500, using connectors called "ROV-mateable connectors".

In the present description, the expressions "lower" and "upper" respectively indicate positions closer to and further away from the reservoir in which the extraction well is operated.

Figure 3:
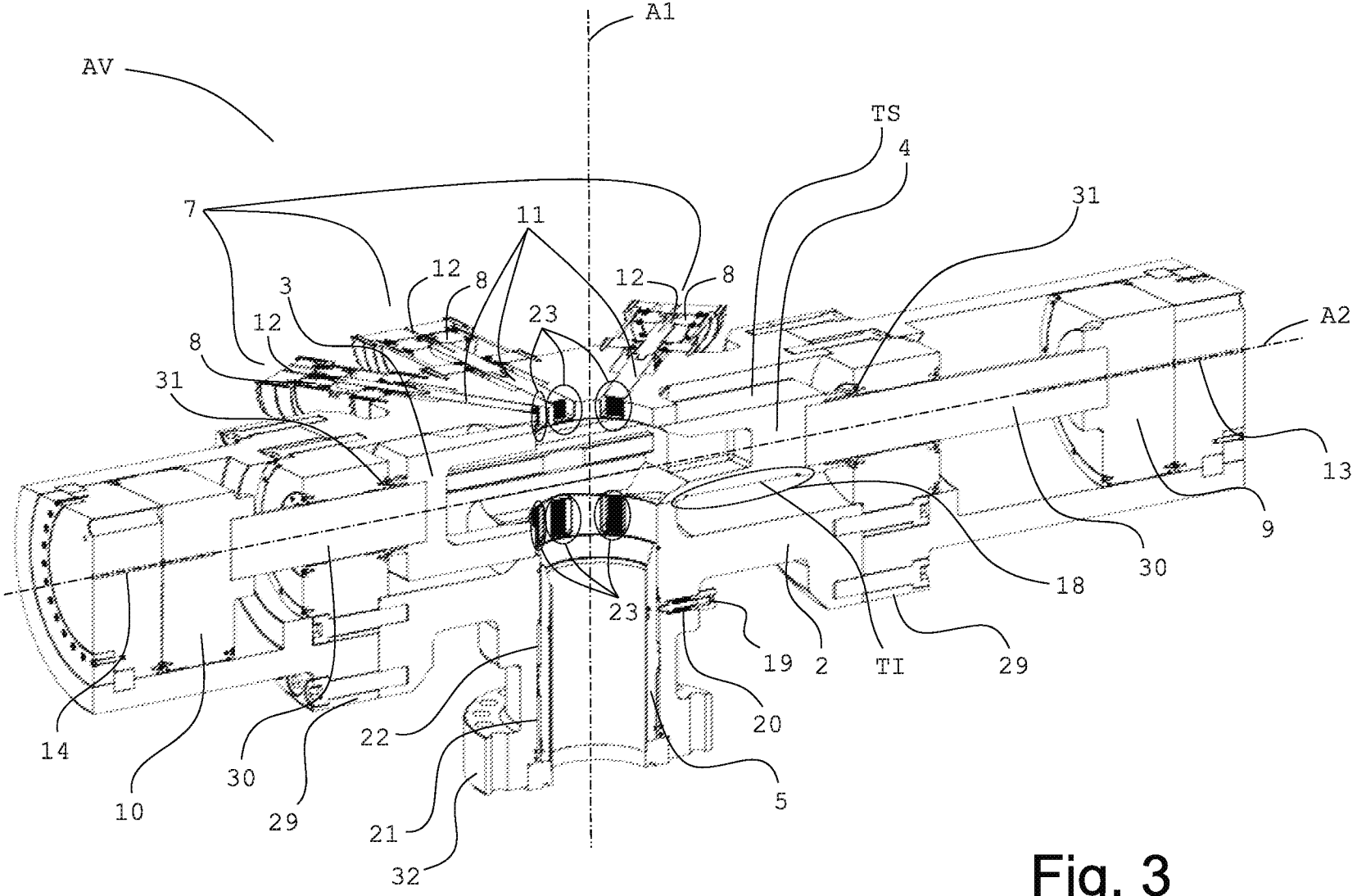
FIG. 3 is an axonometric view with parts of the safety valve in a sectional view, with components removed for the sake of clarity, which shows the valve body, the punch and the counter-punch with the relative actuation mechanisms, the incising devices and the relative actuation mechanisms.
Figure 4:
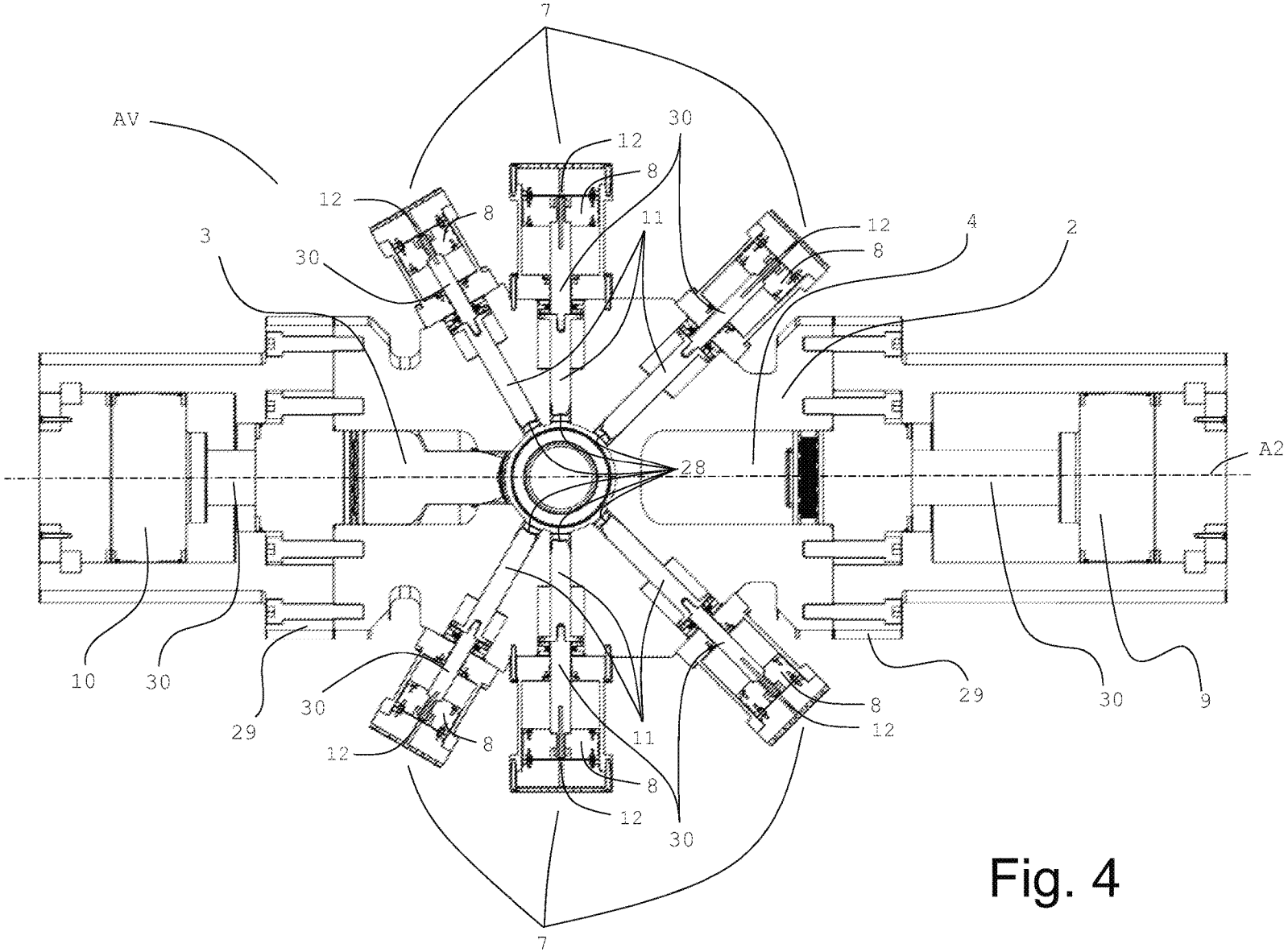
FIG. 4 is a view with parts of the safety valve in a sectional view, with components removed for the sake of clarity, which shows the valve body, the punch and the counter-punch with the relative actuation mechanisms, the incising devices and the relative actuation mechanisms.
Figure 5:
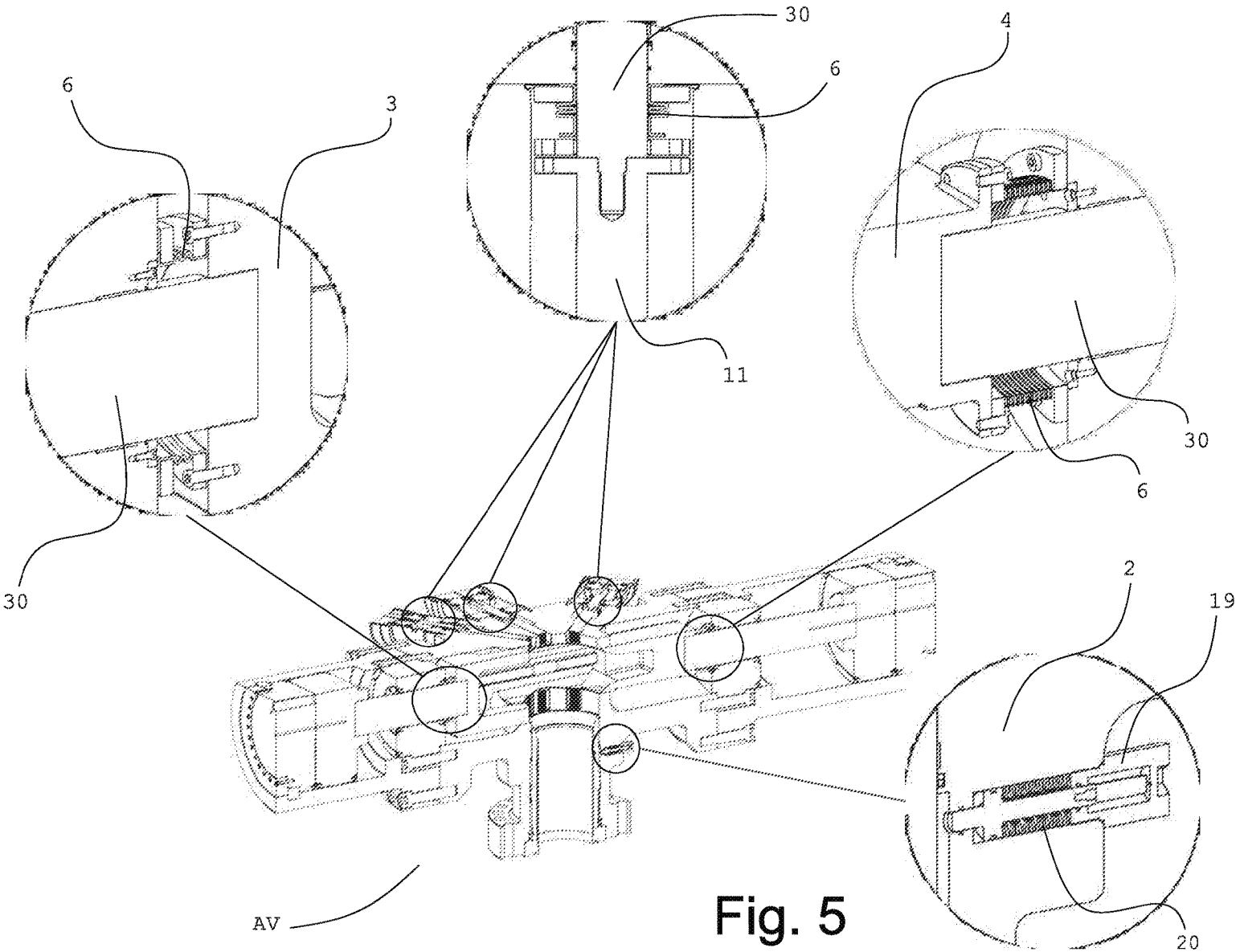
FIG. 5 is a view with parts of the safety valve in a sectional view, with components removed for the sake of clarity, which shows in particular the elastic protection bellows of the seals of the hydraulic stems and blocking pins of the closing collar.
Figure 6:
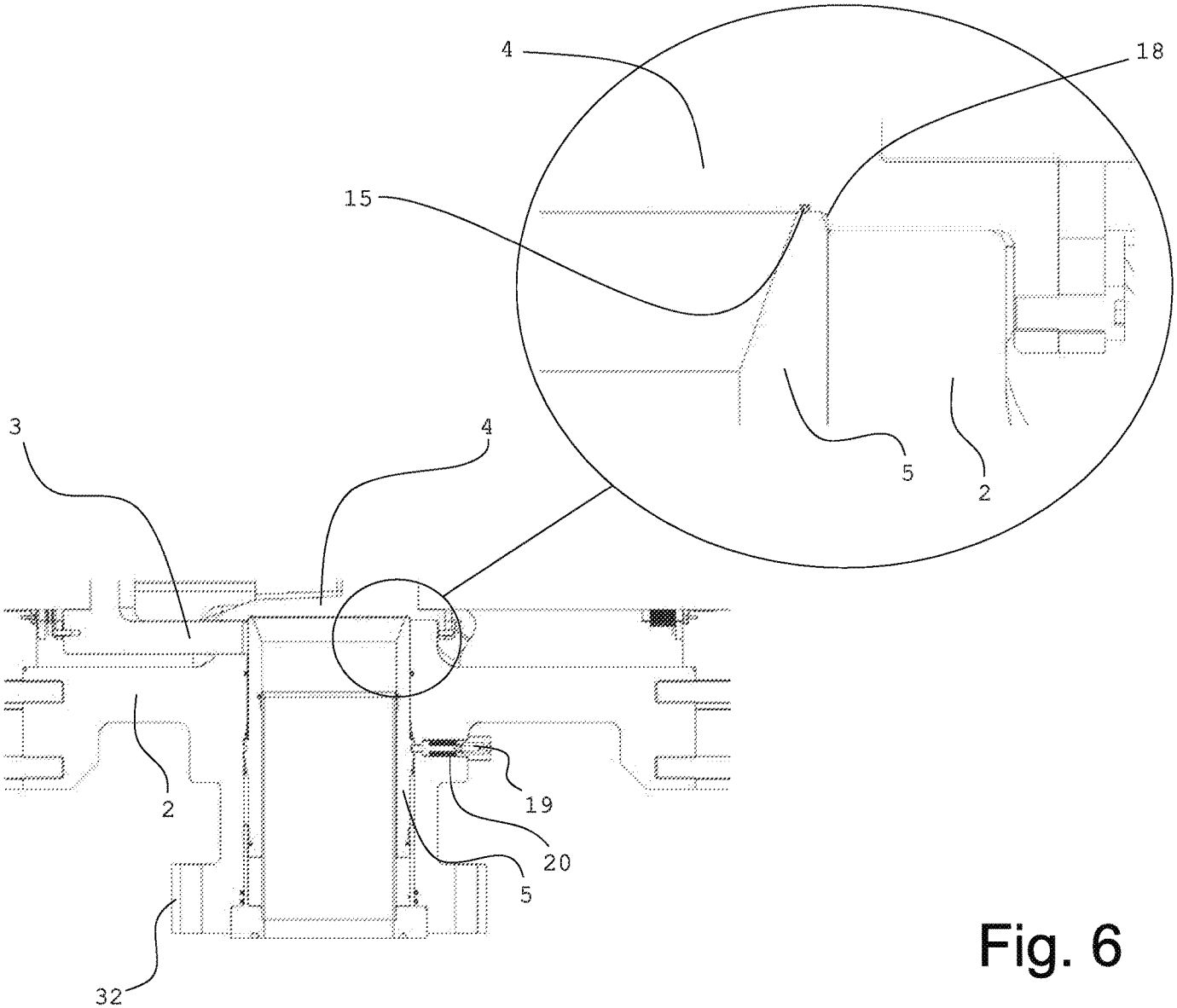
FIG. 6 is a view with parts of the safety valve in a sectional view, with details relating to the shearing punch, with parts removed for the sake of clarity, which shows the detail of the seat in the shearing punch for the seal of the closing collar.

With reference to FIGS. 2, 3 and 4, these show a preferred embodiment example of the safety-valve assembly AV according to the invention, which comprises a valve body 2 in which there is a passage duct 24, preferably straight, conceived for being traversed by a production and/or drilling line designed for containing and transporting, through a tubular element 26, extraction fluids such as, for example, petroleum, oil, water, mud, rock debris and/or soil debris, natural gas, or other fluids to be extracted from an underground reservoir. The valve body 2 is provided with upper and lower detachable joining means, preferably flanged couplings 32, for allowing connection of the safety-valve assembly AV with the production cross and wellhead. The housings for the punch 4 and counter-punch 3 are obtained in the valve body 2, positioned diametrically opposite to one another with a common longitudinal axis A2 substantially perpendicular to the longitudinal axis A1 of the valve; the safety-valve assembly AV is provided with a punch 4, sliding linearly in a controlled mode in the housing along the axis A2 which intersects the longitudinal axis of the pipe A1; the safety-valve assembly AV is provided with a counter-punch 3, positioned diametrically opposite to the punch 4, sliding linearly in a controlled manner in the housing along the axis A2 which intersects the longitudinal axis of the pipe A1. Said punch 4 and counter-punch 3, complete with respective actuation mechanisms, are assembled on the valve body 2 through detachable joints, preferably flanged 29. The punch 4 is configured for resisting the vertical thrust due to the pressure of the well fluids without causing a significant flexion.

The safety-valve assembly AV is characterized in that the punch 4 and counter-punch 3 are configured so as to allow the counter-punch 3 to slidingly receive the punch 4 in its interior in order to create two different shearing planes; the counter-punch 3 being configured so as to have a hollow part suitable for receiving the section of tubular material and the punch 4 in the linear motion during the shearing operation.

The tubular elements 26 can be so-called casings, production tubings or pipe strings comprising drill pipes and tool joints (in technical jargon).

In a preferred embodiment of the invention, the punch 4 and the counter-punch 3 have a "V"-shaped configuration in the part which comes into contact with the tubular element 26 so as to exert a centering function of the above-mentioned tubular element when said punches engage the tubular element.

In a preferred embodiment, the punch 4 and the counter-punch 3 are actuated by means of respective hydraulic pistons 9 and 10.

In a further preferred embodiment, the punch 4 and the counter-punch 3 are controlled in the operative phases through the respective position sensors 13 and 14.

As can be seen from FIG. 2, the following two planes can be identified in the valve body 2:

the upper cutting plane TS substantially orthogonal to the longitudinal axis A1 of the valve and containing the upper side of the punch 4;

the lower cutting plane TI substantially orthogonal to the longitudinal axis A1 of the valve and containing the lower side of the punch 4.

In order to make the shearing process more effective, in a preferred embodiment, the valve assembly AV can be provided with an upper incision system which incises the surface of the tubular element 26, said notches contained in an upper incision plane IS, parallel to the upper cutting plane TS, lying above TS at a maximum distance preferably ranging from 0.1 mm to 10 mm from TS measured in the direction of the axis A1.

In a further preferred embodiment, the valve assembly AV can be provided with a lower incision system which incises the surface of the tubular element 26, said notches contained in a lower incision plane II, parallel to the lower cutting plane TI, lying below TI at a maximum distance preferably ranging from 0.1 mm to 10 mm from TI measured in the direction of the axis A1.

For this purpose, at least one engraver 7 for each cutting plane TS and TI is mounted on the valve assembly AV; the engravers are configured with cutter-holder bars 11, preferably having a rectangular section, sliding linearly along axes substantially orthogonal to the axis A1 and lying on incision planes IS, II. The cutters 28 are installed on the cutter-holder bars 11. The valve body 2 is designed with cavities 23 suitable for the passage of the engravers 7, enabling contact of the cutters 28 with the surface of the tubular element 26.

In a preferred embodiment, the engravers produce incisions preferably having a triangular form on the surface of the tubular element 26, said incisions having a penetration depth preferably ranging from 0.1 mm to 5 mm.

In a preferred embodiment of the invention, the valve assembly AV is provided with six engravers for each cutting plane, upper and lower, said engravers having a specular arrangement with respect to the plane comprising the axis A1 and the axis A2.

In a preferred embodiment, the engravers 7 are actuated by means of respective hydraulic pistons 8.

In a further preferred embodiment, the engravers 7 are controlled in the operative phases by means of the respective position sensors 12.

In a preferred embodiment of the invention, the punch 4 is configured for incising the surface of the tubular element 26 on the plane TS; in a further preferred configuration of the invention, the punch 4 is configured for incising the surface of the tubular element 26 on the plane TI.

In a preferred embodiment of the invention, the counter-punch 3 is configured for incising the surface of the tubular element 26 on the plane IS; in a further preferred configuration of the invention, the counter-punch 3 is configured for incising the surface of the tubular element 26 on the plane II.

In a preferred embodiment of the invention, the force that can be impressed on the tubular element 26 by the punch 4 and the counter-punch 3 preferably ranges from 30,000 kN to 40,000 kN; the force expressed by each engraver 7 preferably ranges from 3,000 kN to 10,000 kN.

In a preferred embodiment of the invention, the seals 31 of the stems 30 of the hydraulic pistons 8,9 and 10 are protected from well fluids by means of elastic bellows 6, preferably metallic or made of PTFE. The elastic bellows 6 allow small movements of the relative pistons. Said movements, set at regular time intervals (in the order of 1-2 months), are useful for lubricating the seals 31, preventing sticking and ensuring the necessary reliability over a long time period (explorative phase and production phase of the well). In the case of actuation of the valve, the force of the pistons 8, 9 or 10 shears the fixing elements of the bellows 6 to the stems 30, which then continue their stroke for exerting specific functions.

In a preferred embodiment of the invention, the chambers 21 and 22 of the closing collar 5 and volumes confined by the protection bellows 6 are filled with an inert fluid and kept at the same pressure as the well fluids which pass through the valve body 2 by means of pressure-compensating devices 16, 17. The use of pressure-compensating devices is also envisaged for the protection bellows 6 installed for protecting the seals of the stems 30 of the hydraulic pistons 8 of the engravers 7. This system allows the seals to be isolated from the well fluids, avoiding damage to the protection bellows 6.

Figure 7:
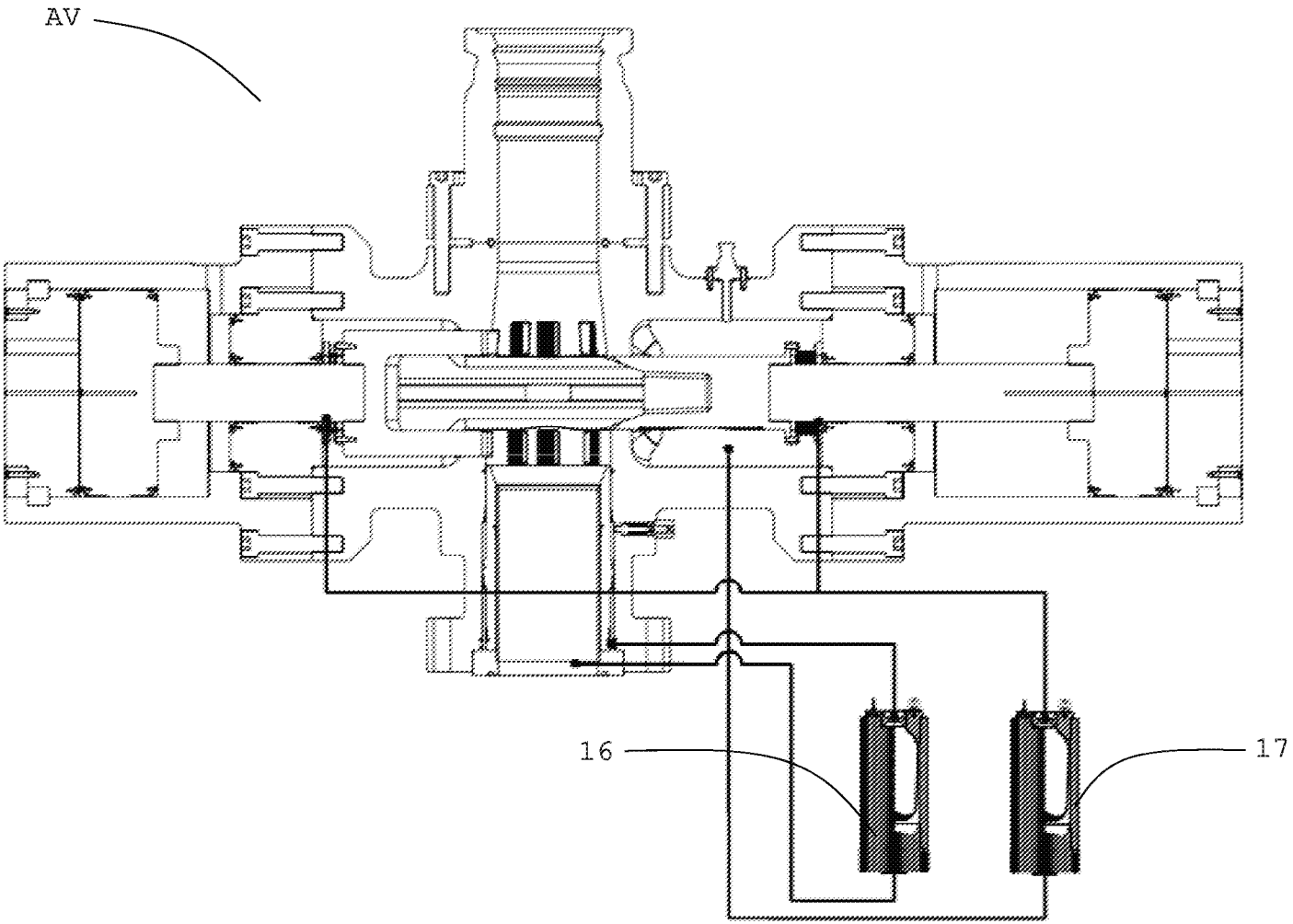
FIG. 7 is a view with parts of the safety valve in a sectional view, which shows the functioning of the pressure compensation devices, with parts removed for the sake of clarity.

With reference to FIG. 7, after the shearing of the tubular element 26 and removal of the tubular section 27, the counter-punch 3 is withdrawn in the starting position, whereas the punch 4 is in the run-end position completely engaging the section of the passage duct 24. The closing of the valve with a hydraulic-seal is effected by means of a mechanism comprising a closing collar 5, substantially cylindrical, sliding along the axis A1 of the valve body 2 and preferably positioned below the punch 4. After withdrawing the lower engravers 7, the closing collar 5 is pushed in abutment against the punch 4 forcing the sealing gasket 15 situated in the recess 18 of the punch 4. For this purpose, a recess 18 is present in the lower surface of the punch 4, guaranteeing a correct seat for the closing collar 5. Once the closing collar 5 has been engaged therein, the recess 18 also has the function of blocking the translating movements of the punch 4 along the axis A2. The force necessary for moving and sealing the closing collar 5 is provided by hydraulically pressurizing the chamber 21 positioned between the passage duct 24 and the outer surface of the closing collar 5.

Once the closing position has been reached, the closing collar 5 is blocked in the sealing position by means of one or more blocking pins 19, so as to keep said closing collar 5 in abutment on the sealing recess 18 situated in the punch 4 also in the absence of hydraulic pressure. The blocking pins 19 are pushed into corresponding grooves in the closing collar 5 by means of one or more corresponding springs 20 and, when the movement of said collar is required, the blocking pins 19 are withdrawn by means of hydraulic pressure exerted through the specific circuit which, as it advantageously communicates with said pins, allows them to be withdrawn overcoming the force of the springs 20. The pressurization of the chamber 22, positioned between the passage duct 24 and the outer surface of the closing collar 5, allows the downward sliding movement of the closing collar 5 which becomes disengaged from the recess 18. The hydraulic chambers 21 and 22 do not communicate with each other.

In a preferred embodiment of the invention, the valve assembly AV is designed for being installed on a seabed submerged by a water head up to 4,000 m deep.

Figure 8A:
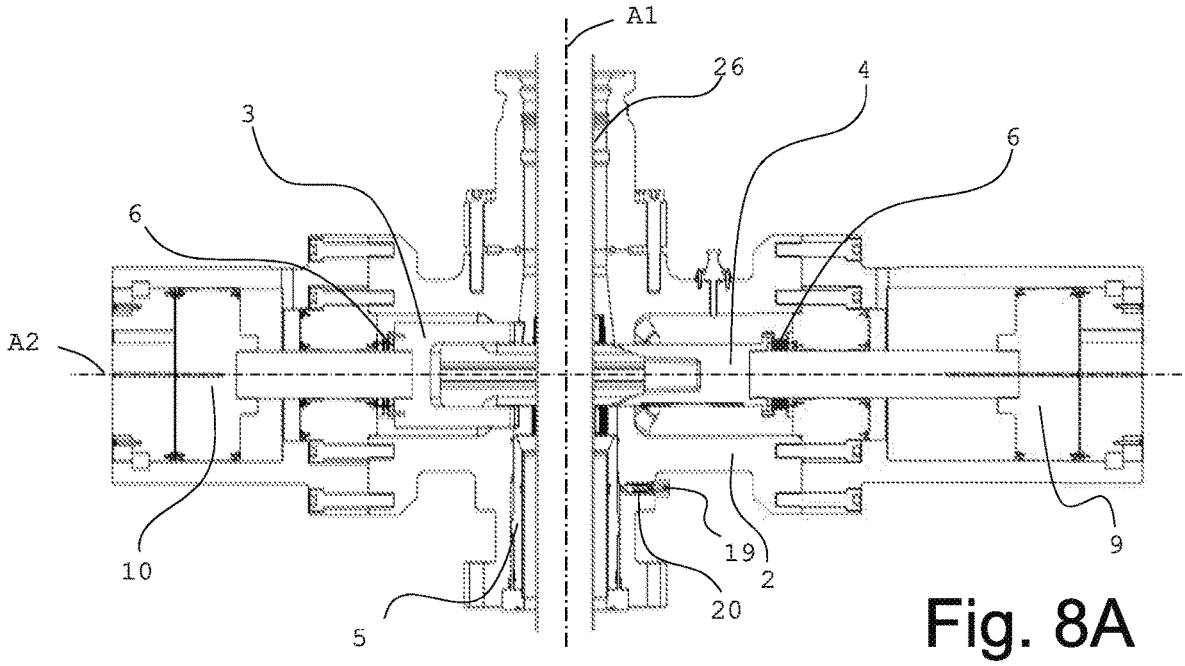
Figure 8B:
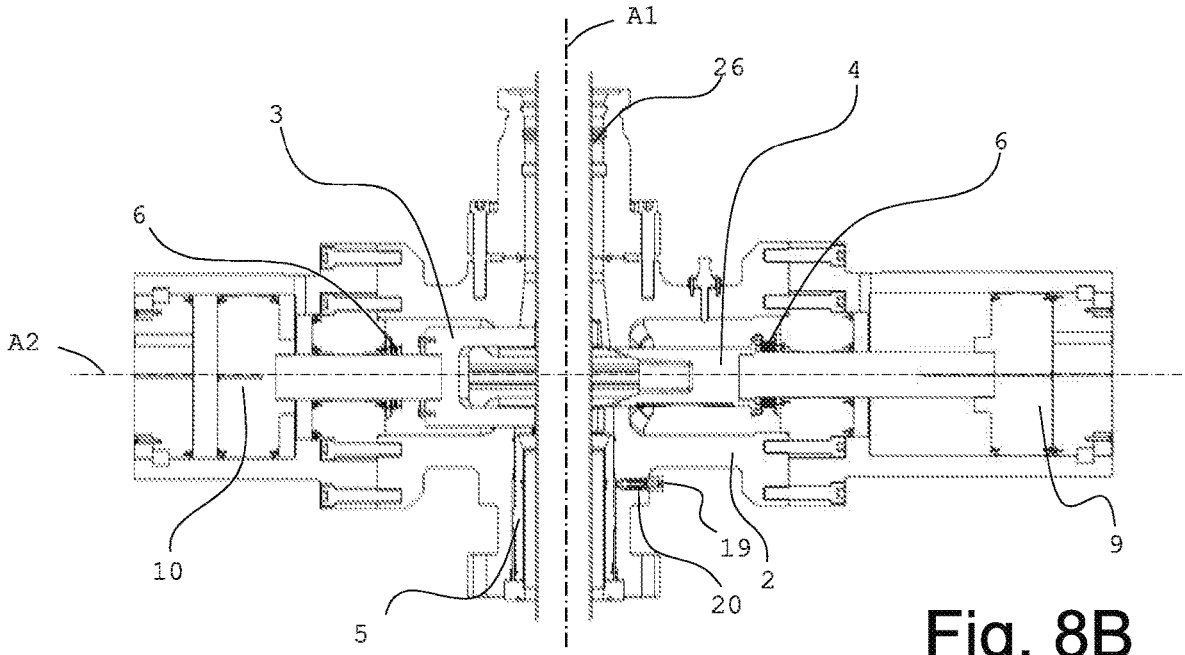
Figure 8C:
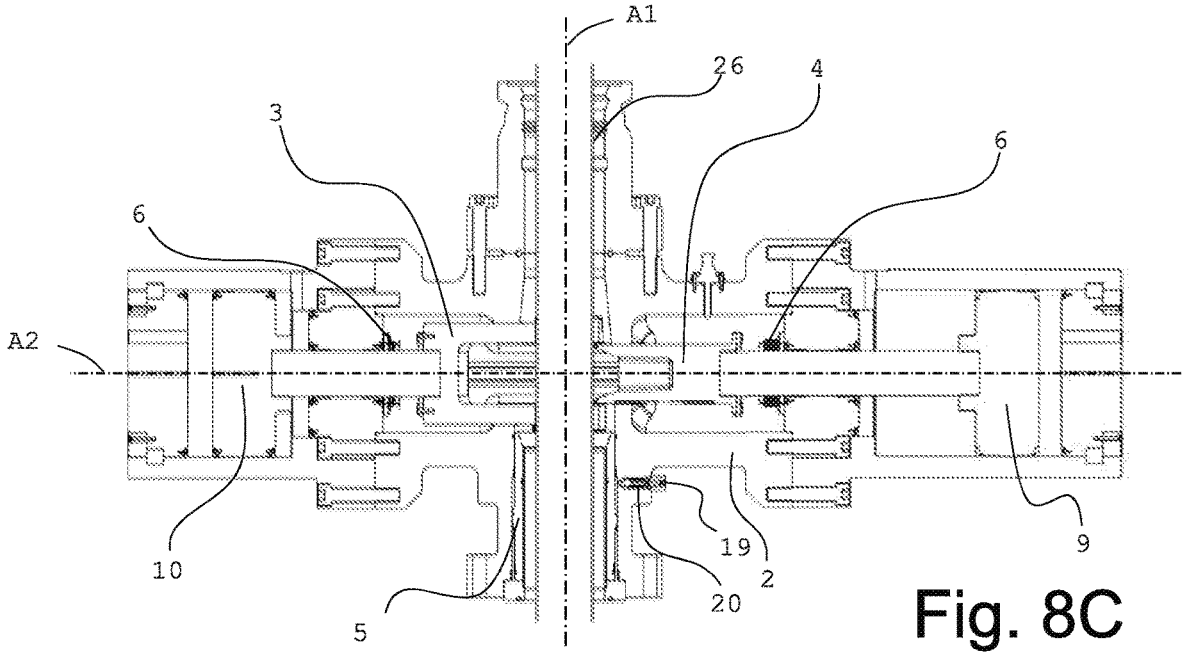
Figure 8D:
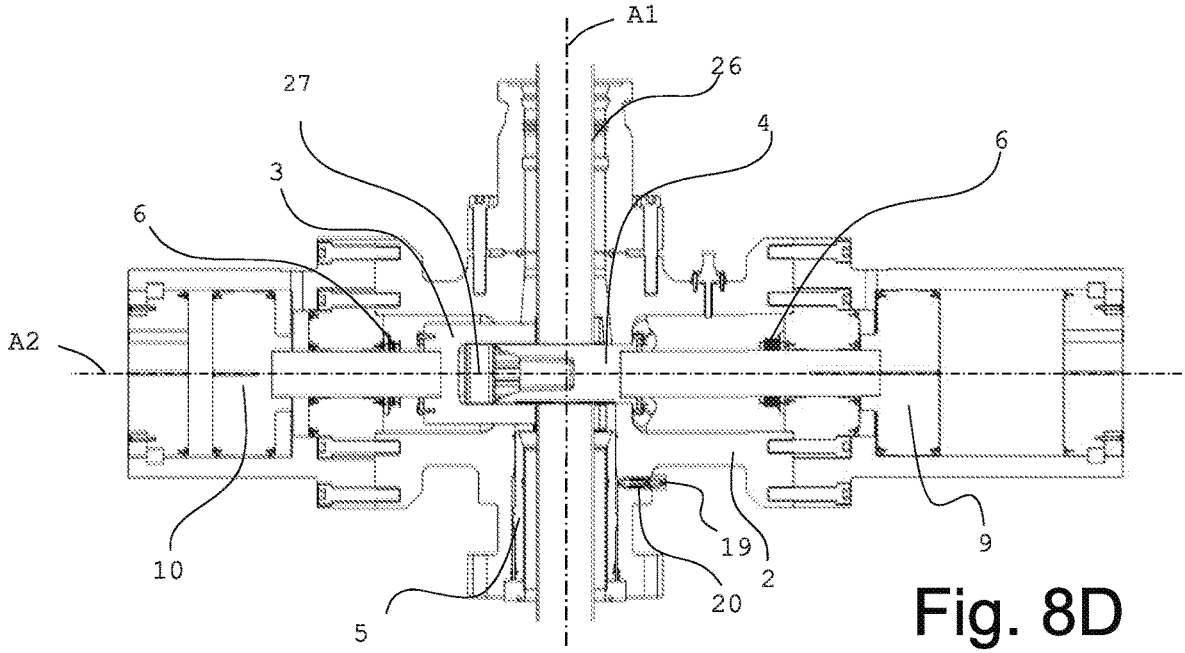
Figure 8E:
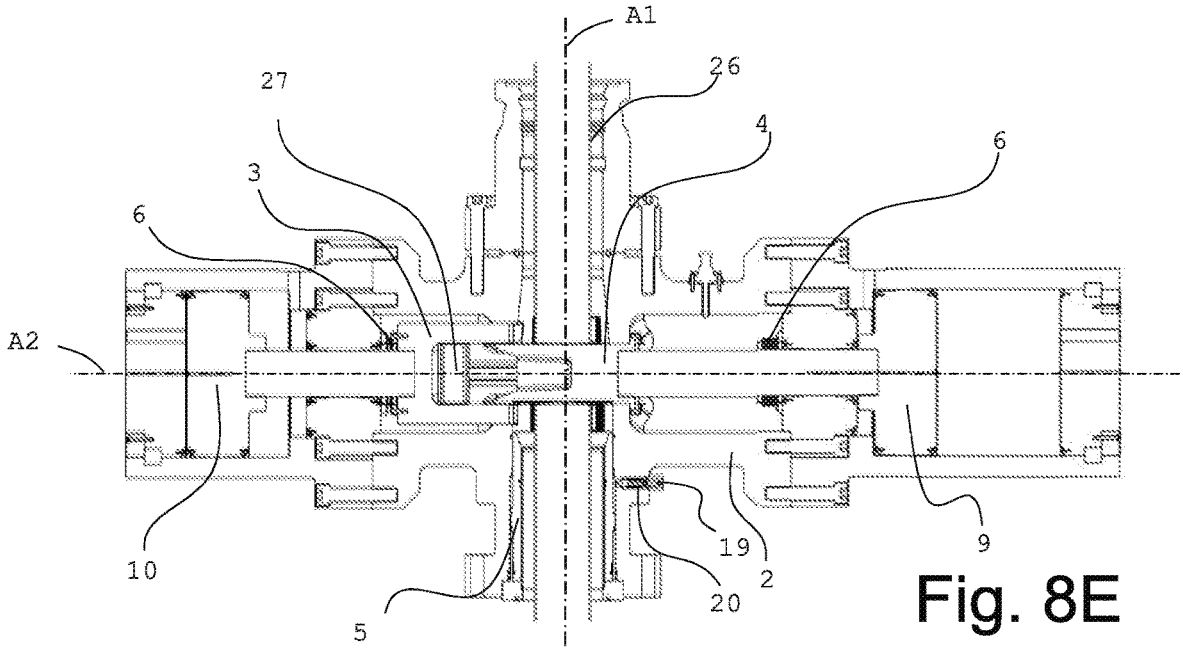
Figure 8F:
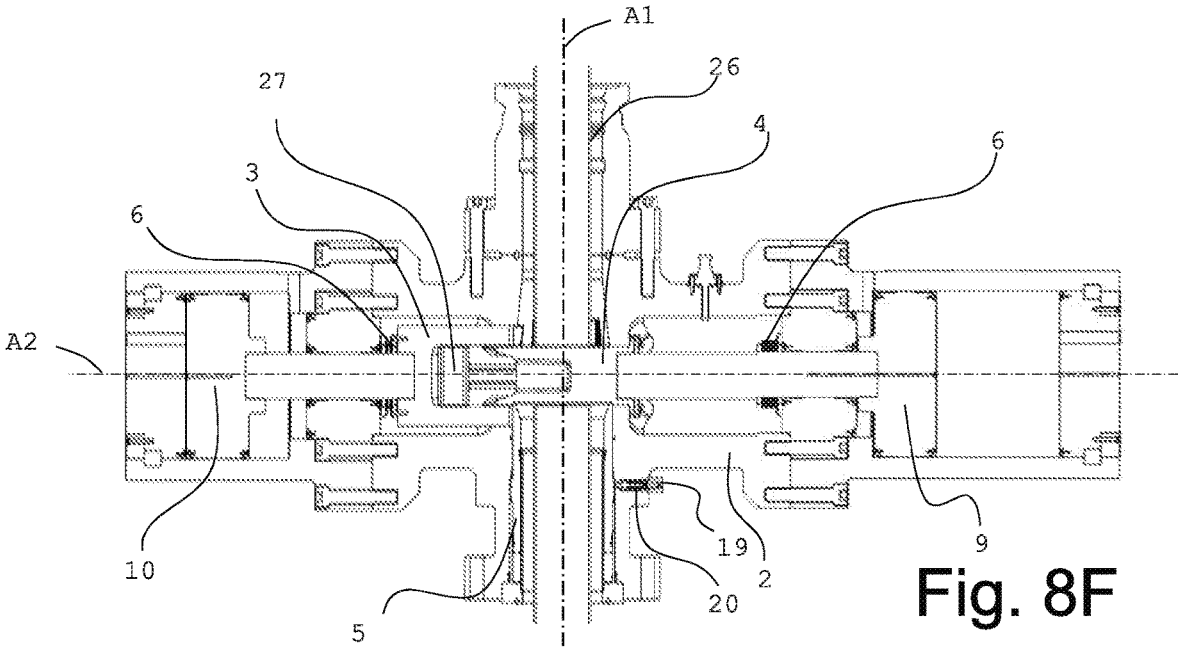
Figure 8G:
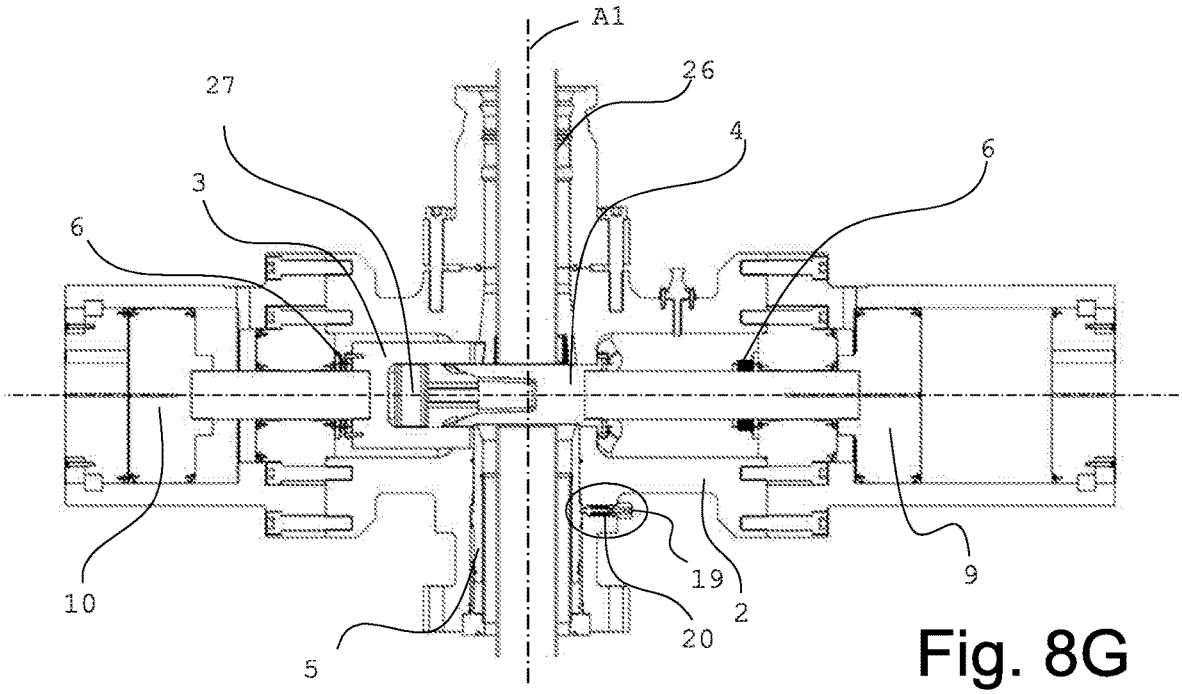

With reference to FIGS. 8A-G, the closing process of the valve assembly AV comprises the following phases:

centering the tubular element 26 with respect to the passage duct 24 thanks to the "V"-shaped configuration of the punch 4 and counter-punch 3; for this purpose, the valve is actuated by slidingly moving the counter-punch 3 in a controlled mode towards the tubular element 26, until contact is made between the counter-punch 3 and the surface of the tubular element 26 (FIG. 8B); whereas the counter-punch 3 is kept in position, the punch 4 is subsequently slidingly moved in a controlled mode towards the tubular element 26 until contact is made between the punch 4 and the surface of the tubular element 26 (FIG. 8C)

incising the tubular element 26; for this purpose, with the two punches 3 and 4 in contact with the tubular element 26, a force is exerted on the tubular element 26 on the part of the punch 4 and counter-punch 3 so as to effect incisions on the surface of the tubular element 26; at the same time, the engravers 7 are selectively moved close to the tubular element 26 until they come into contact and subsequently, by the application of controlled forces, they incise the surface of the tubular element 26 so as to create a weakened area of the tubular section favourable for the controlled propagation of the fracture during the shearing. The engravers 7 can be selectively engaged in the shearing process in a number depending on the diameter of the tubular element 26 which passes through the valve body 2;

shearing the tubular element 26; for this purpose, the counter-punch 3 remains in position for opposing the cutting force, whereas the punch 4 increases the force exerted on the tubular element 26 until reaching the shear stress necessary for shearing the tubular element engaged in the valve. When the fracture of the tubular material 26 is triggered, the force exerted by the punch 3 reaches its maximum, this force subsequently decreases during the shearing process;

removing the tubular section 27 (FIGS. 8D-E); for this purpose, the counter-punch 3 remains in the contact position with the pipe 26 until the force exerted by the punch 4 reaches its maximum, the counter-punch 3 is subsequently withdrawn linearly according to the axis A2 allowing the punch 3 to advance and the tubular section 27 to be removed;

interrupting the flow of fluids through the valve assembly (AV) (FIG. 8E); for this purpose, the punch 4, advancing as far as its stroke-end, completely blocks the internal passage section of the valve body 2;

creating a hydraulic-seal inside the valve assembly (AV) (FIG. 8F); for this purpose, after withdrawing the lower engravers 7, and the blocking pins 19 by means of the hydraulic pressure exerted through a dedicated circuit which, as it advantageously communicates with said pins, allows them to be withdrawn, overcoming the force of the springs 20; the closing collar 5 is pushed in abutment towards the punch 4 forcing the sealing gasket 15 situated in the recess 18 of the punch 4; the recess 18 is formed in the lower surface of the punch 4, guaranteeing a correct seat for the closing collar 5.

blocking the closing collar 5 (FIG. 8G); for this purpose, the blocking pins 19 are pushed into corresponding grooves of the closing collar 5 by means of one or more corresponding springs 20 removing pressure from the dedicated hydraulic circuit;

extracting the upper sheared portion of the tubular element 26 from the valve body 2; for this purpose, the upper engravers 7 are withdrawn to allow the disengagement of the tubular element 26.

The actuation of the safety valve is of the reversible type to allow the restoration of the well if this is possible.

The re-opening process of the valve assembly AV comprises the following phases:

opening the hydraulic-seal of the valve assembly AV; for this purpose, the dedicated hydraulic circuit is pressurized with the movement of the blocking pins 19 with the effect of unblocking said pins, the chamber 22 is then pressurized, allowing the downward sliding movement of the closing collar 5 which becomes disengaged from the recess 18.

withdrawing the punch 4 into the initial position, freeing the passage duct 24.

It can therefore be seen that the safety valve for wells for the extraction of hydrocarbons according to the present invention achieves the objectives previously indicated, obtaining numerous advantages, among which:

shearing action of the tubular elements facilitated by the development of preferential fracture planes due to the presence of incisions, consequently more versatile with respect to the known devices, considering the variety of geometries to be cut: from tool joints to casings;

creation of a defined shearing surface, so as to avoid the production of metal debris that prevent the subsequent passage of the closing element;

capacity of also effecting the shearing of the tubular elements under critical conditions;

protection of the seals of the piston stems from well fluids, thus avoiding maintenance of the seals and leaving the safety valve installed for the whole operational life of the well.

The safety valve for wells for the extraction of hydrocarbons of the present invention thus conceived, can in any case undergo numerous modifications and variants, all included in the same inventive concept; furthermore, all the details can be substituted by technically equivalent elements. In practice, the materials used, as also the forms and dimensions can vary according to technical requirements.

The protection scope of the invention is therefore defined by the enclosed claims.

The invention claimed is:

1. A safety valve assembly, comprising:

a valve body including a passage duct, configured for passage of a production and/or drilling line configured to contain and transport, through a tubular element, extraction fluids or other fluids to be extracted from an underground reservoir;

the valve assembly including a punch sliding linearly in a controlled mode along an axis which intersects a longitudinal axis of the tubular element and a counter-punch, positioned diametrically opposite to the punch, sliding linearly in a controlled mode along the axis which intersects the longitudinal axis of the tubular element, the punch includes an upper shearing surface and a lower shearing surface that respectively form an upper cutting plane and a lower cutting plane, each shearing surface configured to contact the tubular element; and at least one engraver for each of the upper and lower cutting planes assembled on the valve, each of the at least one engraver being configured with cutter-holder bars, sliding linearly respectively on an upper incision plane and a lower incision plane along a respective axis substantially orthogonal to the longitudinal axis of the tubular element, wherein each of the at least one engravers includes a cutter provided with each of respective cutter-holder bars, the cutter configured to incise a surface of the tubular element so as to create a weakened area of the tubular element, wherein the valve body includes cavities for passage of the at least one engraver, wherein the counter-punch is configured to have a hollow part configured to slidingly receive a section of tubular material and the punch in its interior, in linear movement during a shearing operation, and wherein the upper shearing surface and the lower shearing surface are spaced apart from each other in the longitudinal axis direction of the tubular element so as to create the upper and lower cutting planes through the tubular element during the shearing operation.

2. The valve assembly according to claim 1, wherein the punch and the counter-punch have a V-shaped configuration in the part which comes into contact with the tubular element.

3. The valve assembly according to claim 1, wherein the punch and the counter-punch are configured to incise a surface of the tubular element.

4. The valve assembly according to claim 1, wherein the valve assembly includes from four to six engravers for each of the upper and lower cutting planes, the engravers having a specular arrangement with respect to the plane including the axis and the longitudinal axis of the tubular element.

5. The valve assembly according to claim 1, wherein the upper incision plane is parallel to the upper cutting plane, lying above the upper cutting plane at a distance ranging from 0.1 mm to 10 mm from the upper cutting plane measured in the direction of the longitudinal axis of the tubular element.

6. The valve assembly according to claim 1, wherein the lower incision plane is parallel to the lower cutting plane, lying below the lower cutting plane at a distance ranging from 0.1 mm to 10 mm from the lower cutting plane measured in the direction of the longitudinal axis of the tubular element.

7. The valve assembly according to claim 1, wherein a number of engravers can be selectively engaged in the shearing process depending on the diameter of the tubular element that passes through the valve body.

8. The valve assembly according to claim 1, wherein the engravers effect incisions on the surface of the tubular element, the incisions having a penetration depth ranging from 0.1 mm to 5 mm.

9. The valve assembly according to claim 1, further comprising hydraulic pistons to actuate the engravers, the pouch and counter-pouch, said piston having stem seals that are protected from well fluids by metallic or PTFE made elastic bellows.

10. The valve assembly according to claim 1, further comprising a closing collar, substantially cylindrical, sliding along the longitudinal axis of the tubular element of the valve body and positioned below the punch.

11. The valve assembly according to claim 10, further comprising at least one blocking pin including a spring and corresponding grooves in the closing collar.

12. The valve assembly according to claim 10, wherein a recess is situated in a lower surface of the punch, guaranteeing a correct seat for the closing collar; the recess comprising a sealing gasket.

13. The valve assembly according to claim 10, further comprising two hydraulic chambers positioned between the passage duct and the external surface of the closing collar; the chambers not communicating with each other.

14. The valve assembly according to claim 13, wherein the two hydraulic chambers of the closing collar and volumes confined by protection bellows are filled with an inert fluid and kept at a same pressure as the well fluids which pass through the valve body by pressure-compensating devices.

15. The valve assembly according to claim 1, further comprising a remote power and control system installed at a predefined distance from a well, the remote power and control system being operatively connected to the valve assembly by electric and hydraulic connections.

16. An extraction well comprising:

a cemented anchoring pipe, anchored or fixed to a seabed or other geological formation in which there is an underground reservoir to be exploited, wherein the pipe is situated close to a surface of the seabed or other geological formation;

a wellhead situated in correspondence with or in proximity of the anchoring pipe;

a safety valve assembly having the characteristics according to claim 1 and assembled on the wellhead.

17. The extraction well according to claim 16, further comprising one or more blow-up preventers or other safety valves, assembled above the valve assembly.

* * * * *